US006227297B1

(12) United States Patent
Milam

(10) Patent No.: US 6,227,297 B1
(45) Date of Patent: May 8, 2001

(54) TUBE CLEANING ARTICLE AND APPARATUS AND METHOD FOR USE WITH A TUBE IN A WELL

(76) Inventor: Jack J. Milam, 2108 Cadwell Ave., Oklahoma City, OK (US) 73170

( * ) Notice: Subject to any disclaimer, the term of this patent is extended or adjusted under 35 U.S.C. 154(b) by 0 days.

(21) Appl. No.: 09/151,983

(22) Filed: Sep. 11, 1998

(51) Int. Cl.[7] ..... E21B 37/00

(52) U.S. Cl. ..... 166/311; 166/173; 15/104.04

(58) Field of Search ..... 166/311, 170, 166/173, 175; 134/8, 22.1; 15/104.03, 104.06, 104.04

(56) References Cited

U.S. PATENT DOCUMENTS

| | | | | |
|---|---|---|---|---|
| 513,917 | * | 1/1894 | Green . | |
| 804,921 | * | 11/1905 | Blackburn . | |
| 2,659,439 | | 11/1953 | Baker | 166/4 |
| 2,884,654 | * | 5/1959 | Fall | 15/104.04 |
| 2,973,996 | | 3/1961 | Self | 308/4 |
| 3,000,185 | * | 9/1961 | Brinkmann | 405/226 |
| 3,056,985 | * | 10/1962 | Meyer | 15/104.04 |
| 3,072,195 | | 1/1963 | Kluck | 166/241 |
| 3,360,846 | | 1/1968 | Schellstede et al. | 29/447 |
| 3,439,075 | | 4/1969 | Bauer et al. | 264/45 |

(List continued on next page.)

OTHER PUBLICATIONS

Publication entitled "New From BJ Turbeco—D–Mudder 'A Turbeco Inc. Product,'" Davis–Lynch, Inc.

One page entitled "CO–Axial Spiral," Halliburton Oil Well Cementing Co. (published or in use before Sep. 1, 1997). (Ex. A).

One page entitled "Hall's Spiral Casing Guide," Houston Pipe Appliance Company (published or in use before Sep. 1, 1997). (Ex. B).

One page Larkin Packer Company, Inc. (published or in use before Sep. 1, 1997). (Ex. C).

One page Petroleum Equipment Co. Ltd. (published or in use before Sep. 1, 1997). (Ex. D).

Publication entitled "Primary Cementing Equipment for Better Well Completions," Gemoco (published or in use before Sep. 1, 1997). (Ex. E).

One page Petroleum Equipment Co. Ltd. (published or in use before Sep. 1, 1997). (Ex. F).

(List continued on next page.)

*Primary Examiner*—David Bagnell
*Assistant Examiner*—John Kreck
(74) *Attorney, Agent, or Firm*—McAfee & Taft

(57) ABSTRACT

A tube cleaning article removes material from a tube in a well. A resilient member defines an encompassing path around a portion of the outer surface of the tube. The resilient member has a metallic inner surface biased toward the tube when the member is mounted on the tube such that the metallic inner surface scrapes material from the outer surface of the tube in response to reciprocating the tube relative to the resilient member. The metallic inner surface preferably presents more than two metallic edges along a longitudinal path of the outer surface of the tube. A particular implementation includes a split metallic ring. The split preferably extends at a transverse angle to the axial length of the ring. A spacer can be used with the ring. The spacer mounts on the tube such that the ring, when mounted on the tube, is between upper and lower portions of the spacer. A method of cleaning a tube in a well includes reciprocating the tube in the well and scraping the tube with a metal body, disposed around the outer perimeter of the tube, in response to reciprocating the tube. Scraping preferably includes engaging the tube with more than two scraping edges along every longitudinal path around the perimeter of the tube. Scraping also preferably includes housing the metal body within a spacer slidably mounted on the tube and engaged within the well outside the tube.

24 Claims, 3 Drawing Sheets

U.S. PATENT DOCUMENTS

| | | | | |
|---|---|---|---|---|
| 3,818,999 | | 6/1974 | Garrett | 175/325 |
| 3,918,519 | | 11/1975 | Cubberly, Jr. | 166/53 |
| 3,938,853 | | 2/1976 | Jürgens et al. | 308/4 A |
| 4,028,796 | | 6/1977 | Bergstrom | 29/416 |
| 4,101,179 | | 7/1978 | Barron | 308/4 A |
| 4,105,262 | | 8/1978 | Richey | 308/4 A |
| 4,141,386 | | 2/1979 | Bergstrom | 138/147 |
| 4,143,713 | | 3/1979 | Kreft | 166/241 |
| 4,171,560 | | 10/1979 | Garrett | 29/455 R |
| 4,206,808 | | 6/1980 | Kreft | 166/241 |
| 4,219,081 | | 8/1980 | Howe | 166/241 |
| 4,219,980 | | 9/1980 | Loyd | 52/309.1 |
| 4,275,935 | | 6/1981 | Thompson et al. | 308/4 A |
| 4,286,898 | | 9/1981 | Stafford | 405/224 |
| 4,434,125 | | 2/1984 | Lavender et al. | 264/262 |
| 4,436,158 | | 3/1984 | Carstensen | 166/377 |
| 4,458,404 | | 7/1984 | Garrett | 29/455 R |
| 4,658,896 | | 4/1987 | Milam | 166/241 |
| 4,667,361 | * | 5/1987 | Wolcott et al. | 15/104.04 X |
| 4,766,663 | | 8/1988 | Milam | 29/455.1 |
| 5,005,245 | * | 4/1991 | Dooley et al. | 15/104.04 |
| 5,030,291 | * | 7/1991 | Titmas | 134/8 |
| 5,765,968 | * | 6/1998 | Lee | 15/104.04 X |
| 5,881,419 | * | 3/1999 | Millard | 15/104.04 |

OTHER PUBLICATIONS

One page entitled "Drill Pipe/Casing Protectors," Regal Oilfield Products (published or in use before Sep. 1, 1997). (Ex. G).

Three pages B&W Incorporated (published or in use before Sep. 1, 1997). (Ex. H).

Two pages Weatherford Cementation Equipment (published or in use before Sep. 1, 1997). (Ex. I).

One page entitled "(CLS) Clamp–On Stabilizers," SMFI (published or in use before Sep. 1, 1997). ( Ex. J).

One page Regan Forge & Engineering Company (published or in use before Sep. 1, 1997). (Ex. K).

One page Petroleum Equipment Co. Ltd. (published or in use before Sep. 1, 1997). (Ex. L).

One page Petroleum Equipment Co. Ltd. (published or in use before Sep. 1, 1997). (Ex. M).

One page Petroleum Equipment Co. Ltd. (published or in use before Sep. 1, 1997). (Ex. N).

One page entitled "(2S) Sleeve Stabilizers," SMFI (published or in use before Sep. 1, 1997). (Ex. O).

* cited by examiner

TUBE CLEANING ARTICLE AND APPARATUS AND METHOD FOR USE WITH A TUBE IN A WELL

BACKGROUND OF THE INVENTION

This invention relates generally to techniques for cleaning a tube disposed in a well. The invention particularly relates to scraping mud and the like from the outside of a tubular member in an oil or gas well before or during a cementing operation, thereby to improve the bond between the cement and the tubular member.

In drilling and completing oil or gas wells, casing is often installed to line at least part of the wellbore. Sometimes a liner is also installed. The liner usually has a smaller diameter than the casing and is often of a flush-joint construction (i.e., there are no outwardly protruding collars at the joints of the liner) so that the liner can be readily lowered into the bore through the casing after the casing has been set. In this configuration, the liner partially overlaps with the casing, but otherwise it extends below the casing into a deeper region of the well.

To fix the casing or the liner in the wellbore, cement is pumped down the central opening through the tubular string defining the casing or liner and back up the annulus between the outside of the string and the wall of the wellbore. To space the string from the wellbore wall and to scrape the wall to ensure the annulus is open around the entire string, centralizer apparatus are attached to the string prior to lowering it into the well. It is important to have the annulus open so that the cement does not channel along only part of the outside of the string, which channeling results in an improper bond whereby leaks between the bore and the string can occur. Such leaks can allow fluid to uncontrollably escape to the surface, thereby possibly creating a hazardous situation; or the leaks can allow communication of fluids between geological zones, thereby possibly detrimentally contaminating one zone with fluid from another. In addition to, or in lieu of, the use of centralizers, sometimes a liner is rotated or reciprocated during a cementing job to prevent channeling.

Despite the possible benefits of centralizers and reciprocation, drilling mud or other materials may be on the tubular member to be cemented in the well. Such materials can adversely affect or prevent good bonding between the cement and the tubular member. It would be desirable to have some type of article or apparatus or method to reliably clean such materials from the tubular member before or during the cementing process.

A product directed to this need has been advertised by Turbeco Inc. under the term "D-MUDDER." This is described as including a wiper element that seals against the tubular member to wipe a mud film from the outer surface of the tubular member. It is believed that such a wiper seal would rapidly deteriorate in the harsh downhole environment of an oil or gas well; therefore, although this advertised "D-MUDDER" product contemplates the problem addressed by the present invention, there is still the need for an improvement in the technique for cleaning a tubular member in a well.

SUMMARY OF THE INVENTION

The present invention overcomes the above-noted and other shortcomings of the prior art by providing a novel and improved tube cleaning article and related apparatus and method. As used throughout this specification, and in the claims, "tube" refers to any tubular member, or string of such members, with which the present invention can be used. Examples include pipe, tubing, casing, and liners of the type used in oil or gas wells.

The tube cleaning article of the present invention removes material from the outside of a tube in a well. This tube cleaning article comprises a resilient member configured to define an encompassing path around a portion of the outer surface of the tube. The resilient member has a metallic inner surface biased toward the tube when the member is mounted on the tube such that the metallic inner surface scrapes material from the outer surface of the tube in response to reciprocating the tube relative to the resilient member. In a preferred embodiment, the metallic inner surface presents more than two metallic edges along a longitudinal path of the outer surface of the tube.

In a particular aspect of the present invention, an apparatus to scrape material from the outside of a tube in a well comprises a split metallic ring to mount on the outside surface of the tube such that the ring compresses toward the outside surface of the tube but permits relative reciprocation between the tube and the ring. In a preferred embodiment, the split in the ring includes a gap in the circumference of the ring, which gap extends at a transverse angle to the axial length of the ring. The apparatus can further comprise a spacer adapted to mount on the tube such that the ring, when mounted on the tube, is between upper and lower portions of the spacer when the spacer is also mounted on the tube.

A method of cleaning a tube in a well in accordance with the present invention comprises reciprocating the tube in the well and scraping the tube with a metal body, disposed around the outer perimeter of the tube, in response to reciprocating the tube. Scraping the tube with a metal body preferably includes engaging the tube with more than two scraping edges along every longitudinal path around the perimeter of the tube. Scraping the tube with a metal body also preferably includes housing the metal body within a spacer slidably mounted on the tube and engaged within the well outside the tube.

Advantages of the foregoing include that the article and apparatus are relatively easy and inexpensive to make and maintain. They are durable and can withstand the harsh materials, pressures and temperatures encountered in the downhole environment of a well. The present invention readily and reliably removes material, including mill coating and deposits on top of the mill coating, from the outer surfaces of tubes thereby enabling good bonds to form between cement and the tube.

Therefore, from the foregoing, it is a general object of the present invention to provide a novel and improved tube cleaning article and related apparatus and method. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 9 illustrates another embodiment of the tube cleaning article of the present invention.

DETAILED DESCRIPTION OF THE INVENTION

Figure 4:
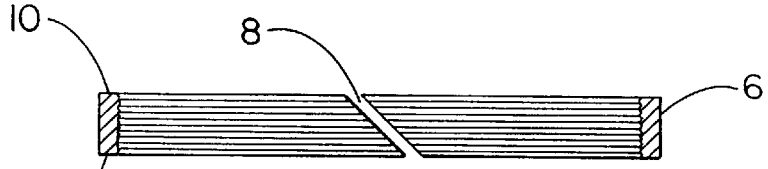
FIG. 4 is a sectional view along line 4—4 of FIG. 1.
Figure 5:
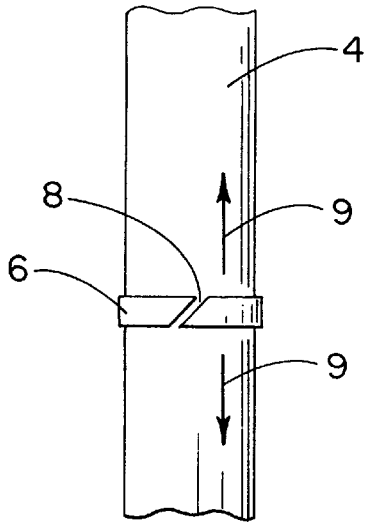
FIG. 5 illustrates the tube cleaning article of FIG. 1 mounted on a tube.

A preferred embodiment of a tube cleaning article 2 to remove material from the outside of a tube in a well is illustrated in FIGS. 1–4, and it is shown mounted on a tube 4 in FIG. 5. The illustrated tube 4 is cylindrical and is of any suitable type for use in an oil or gas well. The term "tube" is defined above, but a non-limiting specific example for FIG. 5 is a casing or liner.

In general, the tube cleaning article 2 comprises a resilient member configured to define an encompassing path around a portion of the outer surface of the tube 4. Specifically, however, the resilient member has at least a metallic inner surface biased toward the tube when the member is mounted on the tube such that the metallic inner surface scrapes material from the outer surface of the tube in response to reciprocating the tube relative to the resilient member. The materials scraped off typically include materials that have been pumped into the well, such as drilling mud; however, particular implementations of the tube cleaning article 2 can even scrape mill coating off the tube.

Referring to the preferred embodiment of the tube cleaning article 2 shown in FIGS. 1–4, the resilient member of this embodiment includes a ring 6 made entirely of metal (i.e., not just the inner surface) but having an opening 8 in the ring. This split metallic ring 6 mounts on the outside surface of the tube 4 such that the ring 6 compresses toward the outside surface of the tube 4 but permits relative reciprocation between the tube 4 and the ring 6. This compressive characteristic is achieved in this embodiment by making the inner diameter of the ring 6 slightly smaller than the outer diameter of the tube 4 (e.g., a 5.437-inches inner diameter for the ring 6 and a 5.5-inches outer diameter for the tube 4). Thus, the ring 6 is spread apart to receive the tube 4 and then, because of the resiliency of the ring 6, it tends to return to its prior shape and thereby compresses toward the tube 4.

The ring 6 is preferably made of a sturdy, durable metal that can withstand the materials, pressures, temperatures, etc. encountered in an oil or gas well environment; therefore, the ring 6 is not highly flexible, but it is resilient enough to be used as described above. Examples of suitable metals from which to make the ring 6 include steel grades 1020, 4140 and 1095. In a particular example, the ring 6 is made of steel stock which is turned in known manner to process the outer surface of the ring to the desired diameter and appearance. This stock is bored and faced to the desired inner diameter. Although the inner surface need not be further processed, the inner surface of the illustrated embodiment of FIGS. 1–4 is threaded or otherwise processed to form multiple scraping ridges on the inner surface of the ring 6 (further described below). The material is cut to the desired axial length and the opening 8 is also cut. These manufacturing processes can be performed using known techniques. The result is a resilient split steel ring in accordance with the present invention.

Figure 8:
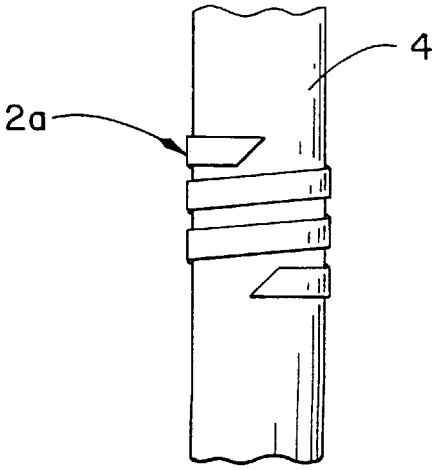
FIG. 8 illustrates another embodiment of the tube cleaning article of the present invention.
Figure 3:
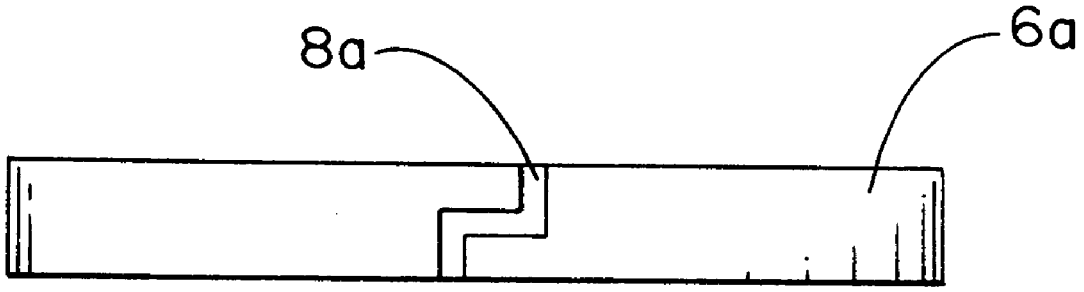

In the embodiment of FIGS. 1–5, the metallic inner surface of the ring 6 extends circularly around the tube 4 when the resilient ring is mounted on the tube. Other configurations can, however, be used. For example, the metallic inner surface can extend along a spiral or helical path along a portion of the length of the tube as illustrated in FIG. 8 (this embodiment, designated by the reference numeral 2*a*, can preferably be made using suitable metal stock and a known type of spring winding machine). In general, the metallic inner surface, and typically the entire resilient member itself, preferably has the same shape as the cross-sectional shape of the outer surface of the tube taken perpendicular to the length of the tube. Thus, if the outer shape of the tube were something other than circular or cylindrical, the resilient member, or at least the inner surface thereof, preferably conforms to that shape.

The opening 8 in the ring 6 defines a gap in the circumference of the ring. This gap extends at a transverse angle to the axial length of the ring. The angle is sufficient to ensure that the ends of the ring 6 at the gap 8 overlap when the ring 6 is on the tube 4 (a non-limiting example of a suitable angle is 450°). This ensures metallic coverage around the entire circumference of the tube 4, which in turn ensures complete scraping coverage around the tube 4 when the ring 6 is used to clean mud or other material from the outer surface of the tube 4.

Figure 1:
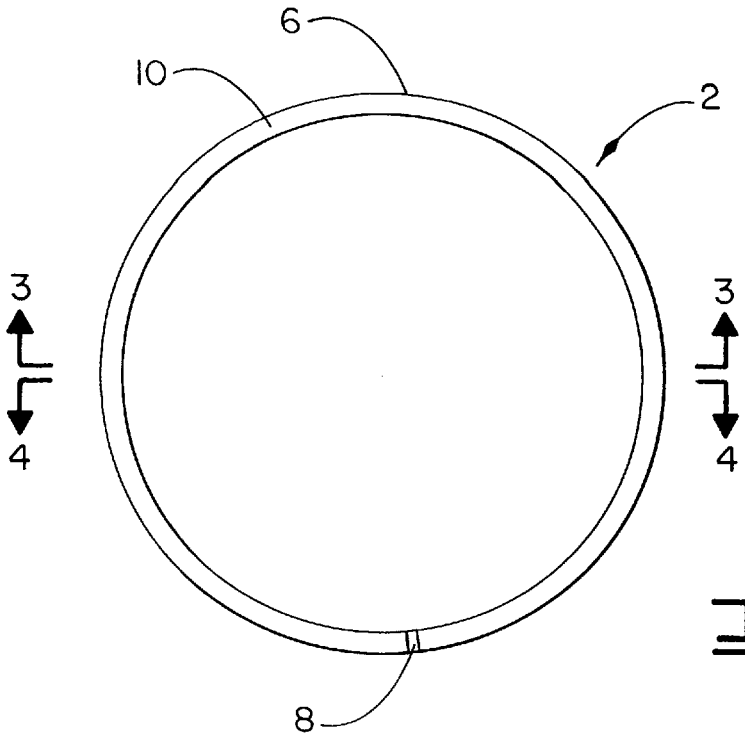
FIG. 1 is a plan view of a preferred embodiment tube cleaning article of the present invention.
Figure 2:
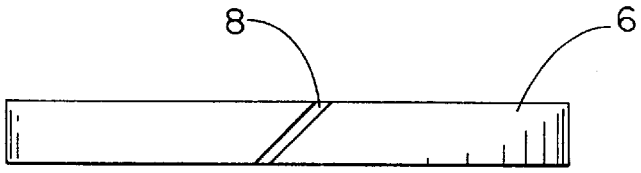
FIG. 2 is a side view of the tube cleaning article shown in FIG. 1.
Figure 3:
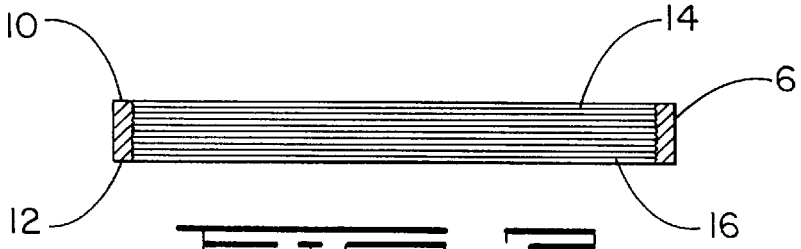
FIG. 3 is a sectional view along line 3—3 of FIG. 1.

To provide a transverse gap, the opening need not be straight as illustrated in FIGS. 2 and 4. The opening can comprise curves or linear segments defining a serpentine or sinuous opening which from end-to-end is transverse to the axial length of the ring. An example of one such opening 8*a* in a ring 6a of the present invention is illustrated in FIG. 9.

The metallic inner surface of the ring of the present invention can be formed to present a single scraping edge, such as by making the inner surface convex or by making a single tapered sharp crest, for example, protrude radially inwardly from the rest of the inner surface (e.g., by machining the rest of the inner surface to a larger inner diameter for the ring and machining the inwardly protruding ridge to the desired shape). In other embodiments, the inner surface can present at least two scraping edges (e.g., by forming the aforementioned ridge to have two edges or by the top and bottom edges of a constant-diameter inner surface of the ring). However, referring to FIGS. 3 and 4, the metallic inner surface of the ring 6 preferably presents more than two metallic edges along a longitudinal path of the outer surface of the tube 4 (e.g., path 9 identified in FIG. 5). Taking any vertical line of the ring 6 as oriented in FIGS. 3 and 4, there are more than two metallic edges defined along the inner surface of the ring 6 to scrape along the outer surface of the tube 8. There are the upper and lower edges 10, 12 of the ring 6 as defined by the limits of the ring body itself, and there are the interior edges 14 defined by one or more spiral or helical threads or parallel grooves 16 (e.g., by cutting a thread or by cutting straight teeth). Such thread(s) or groove (s) extend transverse to the axial lengths of the tube and of the ring. Using such multiple edges is preferred because it reduces the area in contact with the tube and it provides a filing action during relative reciprocation with the tube.

Figure 6:
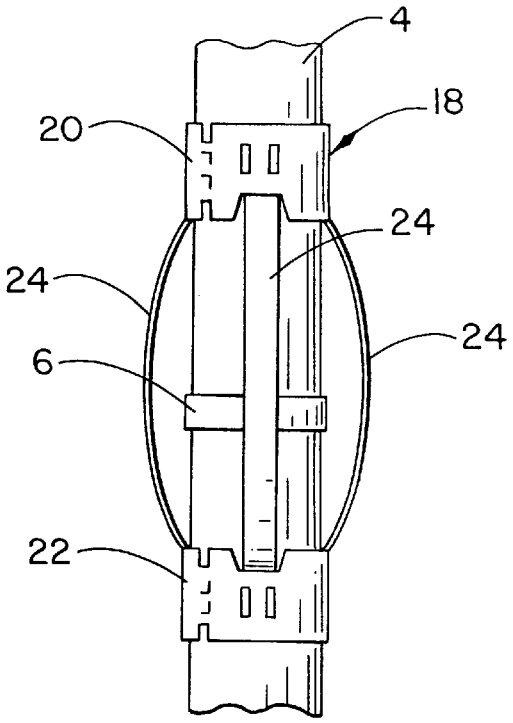
FIG. 6 illustrates a preferred embodiment of an apparatus of the present invention incorporating the tube cleaning article of FIG. 1.
Figure 7:
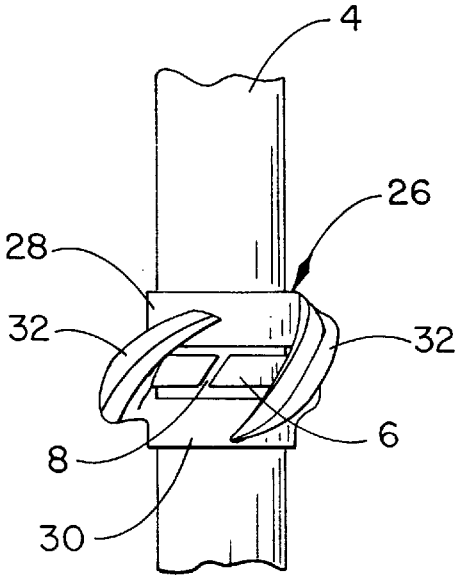
FIG. 7 illustrates another preferred embodiment of an apparatus of the present invention incorporating the tube cleaning article of FIG. 1.

To facilitate or ensure that reciprocation occurs between the tube 4 and the resilient member, such as the ring 6 of FIGS. 1–5, the resilient member needs to be held relatively stationary while tube 4 is reciprocated in the typical case in which the tube is moved up and down by action at the surface of the well. That action is performed as known in the art for reciprocating a tubular string in a well. The resilient member mounted on the tube 4 can be held relatively stationary by any suitable means. In accordance with this, the present invention provides an apparatus to scrape material from the outside of a tube in a well. This apparatus includes the resilient scraper member as described above, and it can further include a spacer adapted to mount on the tube either as part of the resilient member or separate from it. For a separate spacer, the resilient member preferably is between upper and lower portions of such spacer when they are mounted on the tube. Examples of such a spacer are shown in FIGS. 6 and 7. In the embodiment of FIG. 6, the spacer includes a conventional centralizer 18 mounted on the tube 4 and used in known manner. As used with the ring 6 in the embodiment of FIG. 6, the centralizer 18 is opened and then mounted on the tube 4 such that the ring 6, previously mounted on the tube 4, is within the centralizer 18 between the upper and lower end portions 20, 22 thereof. The outwardly bowed interconnecting spring segments 24 of the centralizer 18 frictionally engage the surrounding structure in the well in which the tube 4 is disposed such that when the tube is reciprocated, the centralizer 18 remains relatively stationary as does the ring 6 which is limited in its upward and downward travel by the upper and lower collars 20, 22 of the centralizer 18 that are mounted around the tube 4 but that permit the tube 4 to move up and down relative to the centralizer 18.

The example of the spacer shown in FIG. 7 is a turbolizer 26 (or turbulence-generating centralizer) having a split sleeve body with the ring 6 disposed between longitudinally spaced end sleeve portions 28, 30 of the split sleeve body. Angled turbolizer blades 32 are welded or otherwise suitably attached to the end sleeve portions 28, 30. The blades 32 engage well structure outside the tube 4 such that the turbolizer 20 is relatively stationary to function in the same manner, relative to the ring 6, as described above for the centralizer 18. U.S. Pat. No. 4,658,896 and U.S. Pat. No. 4,766,663 which relate to turbolizers and which were issued to the present inventor are incorporated herein by reference.

In view of the foregoing, the apparatus to scrape material from the outside of a tube in a well can be said to comprise: compressive metallic means for encompassing a portion of an outer surface of a tube in a well and for permitting reciprocation of the tube relative to the compressive metallic means such that material is removed from the tube in response to such reciprocation; and lateral spacer means for mounting on the tube such that the tube is spaced from surrounding well structure. The former can be implemented by any suitable article or apparatus, such as the preferred embodiments of FIGS. 1–4, 8 and 9; however, it is contemplated that other devices meeting the recited limitations might be used regardless of terminology used (e.g., a collar, a sleeve, a band, a helix, a scraper, etc.). As to the latter (i.e., the lateral spacer means), it can be implemented in any suitable manner, two of which are illustrated in FIGS. 6 and 7. In those embodiments, the compressive metallic means lies in an open area between end portions of the spacer means when the compressive metallic means (e.g., the ring 6) and the spacer means (e.g., the centralizer 18 or the turbolizer 20) are mounted on the tube (e.g., the tube 4). Such spacer means generally is not limited to any particular implementation, but encompasses any suitable housing, cage, offset, set-off or other suitable device or structure that limits longitudinal movement of the compressive metallic means in the well when the tube is reciprocated.

In accordance with the foregoing and the method of the present invention, a tube (e.g., the tube 4) is cleaned in a well in which the tube is located by reciprocating the tube in the well and by scraping the tube with a metal body, disposed around the outer perimeter of the tube, in response to reciprocating the tube. This cleaning occurs around the entire circumference of the tube 4 with the embodiments of FIGS. 1–4 and 9 because of the overlapping ends of the ring 6 at the opening or gap 8 or 8*a*. It occurs in the embodiment of FIG. 8 due to the spiral or helix extending more than one course such that the ends overlap and longitudinally align with portions of the band defining the spiral or helix. As illustrated for the ring 6 of FIGS. 1–5, scraping the tube 4 with a metal body preferably includes engaging the tube 4 with more than two scraping edges along every longitudinal path 9 around the perimeter of the tube 4.

For implementations of the method which use components such as illustrated in FIGS. 6 and 7, scraping the tube with a metal body includes housing the metal body within a spacer slidably mounted on the tube and engaged within the well outside the tube. Such a spacer frictionally engages with a relatively fixed structure (e.g., an outer tube or the wall of the wellbore) outside the tube so that the spacer and the metal body contained within the spacer are relatively stationary compared to the travel of the tube during reciprocation of the tube. Thus, for the specific implementations of FIGS. 6 and 7, scraping the tube 4 with the metal body 6 includes housing the metal body within an open space between end sleeve portions of the conventional centralizer 18 or of the split sleeve turbolizer 26 slidably mounted on the tube 4 and engaged within the well outside the tube 4. Thus, as the tube 4 is reciprocated, mud or other coatings on the tube are cleaned off by the one or more edges of the resilient member compressed toward the tube.

Examples

A non-limiting specific example of the ring 6 is a steel ring cut at a 450° angle to form the opening 8. The nominal outer diameter is 5.813 inches and the nominal inner diameter is 5.437 inches. The nominal height is 1.0 inch. The inner surface is cut to have a sharp crest, flat bottom thread 0.062 inch from crest to bottom and at a pitch such that there are ten threads or courses of one or more continuous threads per inch. This steel ring is suitable for a tube having a nominal outer diameter of 5.5 inches.

A non-limiting specific example of the centralizer 18 is a conventional commercially available one of the type illustrated in FIG. 6.

A non-limiting specific example of the split sleeve turbolizer 26 suitable for a tube having an outer diameter of 5.5 inches and the specific ring described above in these examples includes upper and lower end sleeve portions each having nominal inner diameters of 5.625 inches, nominal outer diameters of 6.0 inches, and nominal lengths of 1.5 inches. The sleeve portions are spaced 1.5 inches so the overall turbolizer 26 has a nominal length of 4.5 inches. The turbolizer blades 32 define a nominal outer diameter of 7.625 inches for this turbolizer 26.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A tube cleaning article to remove material from the outside of a tube in a well, comprising a single resilient member configured to define an encompassing path around a portion of the outer surface of the tube, the resilient member having a metallic inner surface biased toward the tube when the member is mounted on the tube such that the metallic inner surface scrapes material from the outer surface of the tube in response to reciprocating the tube relative to the resilient member, wherein the metallic inner surface presents more than two metallic edges, protruding radially inwardly from the rest of the metallic inner surface, along a longitudinal path of the outer surface of the tube.

2. A tube cleaning article as defined in claim 1, wherein the metallic inner surface has at least one continuous thread defined therein to form the more than two metallic edges.

3. A tube cleaning article as defined in claim 1, wherein the metallic inner surface extends circularly around the tube when the resilient member is mounted on the tube.

4. A tube cleaning article as defined in claim 1, wherein the metallic inner surface extends along a spiral path along a portion of the length of the tube when the resilient member is mounted on the tube.

5. A tube cleaning article as defined in claim 1, wherein the metallic inner surface has the same shape as the cross-sectional shape of the outer surface of the tube taken perpendicular to the length of the tube.

6. A tube cleaning article as defined in claim 1, wherein the metallic inner surface defines an inner diameter of the resilient member, which inner diameter is smaller than the outer diameter of the outer surface of the tube.

7. A tube cleaning article to remove material from the outside of a tube in a well, comprising a single resilient member configured to define an encompassing path around a portion of the outer surface of the tube, the resilient member having a metallic inner surface biased toward the tube when the member is mounted on the tube such that the metallic inner surface scrapes material from the outer surface of the tube in response to reciprocating the tube relative to the resilient member, wherein the resilient member includes a ring of metal having an opening in the ring defined between circumferentially spaced but circumferentially aligned ends of the ring to enable the ring to be spread apart to receive the tube.

8. A tube cleaning article as defined in claim 7, wherein the opening defines a gap in the ring extending at a transverse angle to the axial length of the ring.

9. An apparatus to scrape material from the outside of a tube in a well, comprising a split metallic ring to mount on the outside surface of the tube such that the ring compresses toward the outside surface of the tube but permits relative reciprocation between the tube and the ring, wherein the ring presents more than two radially inwardly protruding metallic scraping edges along a longitudinal path of the outer surface of the tube.

10. An apparatus as defined in claim 9, wherein an inner surface of the ring has at least one continuous thread defined therein to form the more than two radially inwardly protruding metallic scraping edges.

11. An apparatus to scrape material from the outside of a tube in a well, comprising a split metallic ring to mount on the outside surface of the tube such that the ring compresses toward the outside surface of the tube but permits relative reciprocation between the tube and the ring, wherein the ring presents more than two metallic scraping edges along a longitudinal path of the outer surface of the tube and wherein the split in the ring includes a gap in the circumference of the ring, which gap extends at a transverse angle to the axial length of the ring.

12. An apparatus to scrape material from the outside of a tube in a well, comprising:

a split metallic ring to mount on the outside surface of the tube such that the ring compresses toward the outside surface of the tube but permits relative reciprocation between the tube and the ring, wherein the ring presents more than two metallic scraping edges along a longitudinal path of the outer surface of the tube; and a spacer adapted to mount on the tube such that the ring, when mounted on the tube, is between upper and lower portions of the spacer when the spacer is also mounted on the tube.

13. An apparatus as defined in claim 12, wherein the spacer includes a centralizer.

14. An apparatus as defined in claim 12, wherein the spacer includes a turbolizer having a split sleeve body with the ring disposed between end sleeve portions of the split sleeve body.

15. An apparatus to scrape material from the outside of a tube in a well, comprising:

compressive metallic means for encompassing a portion of an outer surface of a tube in a well and for permitting reciprocation of the tube relative to the compressive metallic means such that material is removed from the tube in response to such reciprocation; and lateral spacer means for mounting on the tube such that the tube is spaced from surrounding well structure, wherein the lateral spacer means includes two spaced end portions between which is an open area, the compressive metallic means disposed within the open area but not attached directly to the lateral spacer means such that independent longitudinal movement of the compressive metallic means is limited by the spaced end portions when the compressive metallic means and the spacer means are mounted on the tube and the tube is reciprocated in the well.

16. An apparatus as defined in claim 15, wherein the compressive metallic means includes a single resilient member having a metallic inner surface biased toward the tube when the member is mounted on the tube such that the metallic inner surface scrapes material from the outer surface of the tube in response to reciprocating the tube relative to the resilient member, wherein the metallic inner surface presents more than two metallic edges, protruding radially inwardly from the rest of the metallic inner surface, along a longitudinal path of the outer surface of the tube.

17. An apparatus as defined in claim 16, wherein the lateral spacer means is selected from the group consisting of a centralizer and a turbolizer having a split sleeve body.

18. A method of cleaning a tube in a well, comprising:

reciprocating the tube in the well; and scraping the tube with a metal body, disposed around the outer perimeter of the tube, in response to reciprocating the tube, wherein scraping the tube with a metal body includes engaging the tube with more than two radially inwardly protruding metallic scraping edges of the respective metal body along every longitudinal path around the perimeter of the tube.

19. A method of cleaning a tube in a well, comprising:

reciprocating the tube in the well; and scraping the tube with a metal body, disposed around the outer perimeter of the tube, in response to reciprocating the tube, wherein scraping the tube with a metal body includes engaging the tube with more than two radially inwardly directed metallic scraping edges of the respective metal body along every longitudinal path around the perimeter of the tube, wherein scraping the tube with a metal body further includes housing the metal body within a spacer slidably mounted on the tube and frictionally engaged with a relatively fixed structure outside the tube.

20. A method of cleaning a tube in a well, comprising:

reciprocating the tube in the well; and scraping the tube with a metal body, disposed around the outer perimeter of the tube, in response to reciprocating the tube, wherein scraping the tube with a metal body includes housing the metal body within an open area of a spacer slidably mounted on the tube and engaged within the well outside the tube and permitting longitudinal movement of the metal body within the open area between spaced end portions of the spacer.

21. A method as defined in claim 20, further comprising selecting the spacer from the group consisting of a centralizer and a split sleeve turbolizer.

22. An article to remove material from the outside of a casing or liner before cementing the casing or liner in an oil or gas well, the article comprising a ring of processed steel stock suitable for withstanding materials, pressures and temperatures in the oil or gas well adjacent the casing or liner and the ring of processed steel stock having an inner surface bored and faced to a desired inner diameter, the inner surface having formed thereon multiple scraping ridges to engage the outside of the casing or liner in the oil or gas well.

23. An article as defined in claim 22, wherein the ring has an axial length of at least about one inch.

24. An article as defined in claim 23, wherein the processed steel stock is cut to define an opening in the ring throughout, but transverse to, the axial length.

* * * * *